US006329870B1

(12) United States Patent
Dedic

(10) Patent No.: US 6,329,870 B1
(45) Date of Patent: Dec. 11, 2001

(54) REFERENCE VOLTAGE GENERATING CIRCUITRY

(75) Inventor: Ian Juso Dedic, Northolt (GB)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/634,589

(22) Filed: Aug. 8, 2000

(30) Foreign Application Priority Data

Nov. 10, 1999 (GB) ..... 9926647

(51) Int. Cl.[7] ..... G05F 1/10
(52) U.S. Cl. ..... 327/538
(58) Field of Search ..... 327/538, 539, 327/540, 541, 542, 543, 545, 546

(56) References Cited

U.S. PATENT DOCUMENTS 6,064,187 5/2000 Redl et al. ..... 323/285
6,188,211 * 2/2001 Rincon-Mora et al. ..... 323/280

FOREIGN PATENT DOCUMENTS 2 260 833 4/1993 (GB) .

OTHER PUBLICATIONS

09/634,590 Aug. 8, 2000 Dedic Data Multiplexing in Mixed Signal Circuitry Fujitsu Limited.
09/634,738 Aug. 8, 2000 Dedic Switch Driver Circuitry Fujitsu Limited.
09/227202 Jan. 08, 1999 Dedic Switch Driver Circuitry Fujitsu Microelectronics Europe GmbH.
09/227200 Jan. 08, 1999 Schofield Thermometer Coding Circuitry Fujitsu Microelectronics Europe GmbH.
09/137837(CPA) Aug. 21, 1998 Schofield & Dedic Cell Array Circuitry Fujitsu Limited.
09/227201 Jan. 08, 1999 Dedic & Schofield Mixed–Signal Circuitry and Integrated Circuit Devices Fujitsu Limited.
09/227254 Jan. 08, 1999 Dedic Electrostatic Discharge Protection in Semiconductor Devices Fujitsu Limited.
09/382459 Aug. 25, 1999 Dedic & Schofield Jitter Reduction Fujitsu Limted.
09/634,588 Aug.08, 2000 Dedic Current Switching Circuitry Fujitsu Limited.

* cited by examiner

*Primary Examiner*—Jeffrey Zweizig
(74) *Attorney, Agent, or Firm*—Staas & Halsey LLP

(57) ABSTRACT

An integrated circuit device generates a reference voltage ($V_{ref}$) at a load node (B) to which internal load circuitry (not shown) is connected. An amplifier (22) has an output (A) whose impedance has an effective inductive component ($L_{amp}$) in a desired range of operating frequencies of the load circuitry. A first resistance element ($R_1$) is connected between the amplifier output and the load node for supplying the reference voltage to that node. An external capacitor ($C_{ext}$) is connected to a connection terminal (C) of the device. A second resistance element ($R_2$) is connected between the load node and the connection terminal. The resistances of the resistance elements and the capacitance of the external capacitor are chosen so as to reduce an impedance variation with frequency of the load node over the desired range of operating frequencies of the load circuitry that would otherwise result from the effective inductive component. An internal capacitor ($C_{int}$) is preferably connected to the amplifier output to compensate for an inductance ($L_{pin}$) associated with the connection terminal.

31 Claims, 8 Drawing Sheets

REFERENCE VOLTAGE GENERATING CIRCUITRY

BACKGROUND OF THE INVENTION

1. Field of the Invention

The present invention relates to reference voltage generating circuitry, and more particularly to reference voltage generating circuitry in an integrated circuit device.

2. Description of the Related Art

In conventional reference voltage generating circuitry, a basic regulated voltage is derived from an unregulated supply, and this basic regulated voltage is then buffered to produce at an output of the circuitry a reference voltage having a desired current driving capability. The basic regulated voltage may be derived, for example, by a reverse-biased Zener diode, or a bandgap reference circuit, and the buffering may be provided by an operational amplifier.

An output impedance of such circuitry typically appears to be inductive, as the gain of the output buffering stage generally falls off with increasing frequency. As shown in FIG. 1 of the accompanying drawings, the output impedance can be modelled to a reasonable approximation as a fixed inductor. In practice, the actual inductance will not be fixed, but may vary in dependence upon such factors as output current (since the transconductance of an operational amplifier changes with current) and temperature.

Because of the essentially inductive output impedance, the output impedance $Z_O$, as seen by load circuitry connected to the output, increases linearly with a frequency $\omega$ of operation of the load circuitry. This does not pose any problems in the case when the generated reference voltage is fed into "static" load circuitry, i.e. load circuitry that has no varying signals, or has signals varying only in a low frequency range where the inductor has very low impedance.

In practice, however, the load circuitry to which the reference voltage generating circuitry is connected may include elements which switch at high frequencies. For example, FIG. 2 of the accompanying drawings shows an example in which reference voltage generating circuitry 1, with an inductive output impedance $Z_O$, is connected to load circuitry 10 which incorporates switching elements 12, such as transistors. The load circuitry in this example also includes a constant current sink element 14. A constant current I is sunk by the current sink element 14. The effect of the element 14 is to make less significant the changes in the total current drawn by the load circuitry. In this example, the switching elements 12 may be switching currents at a high frequency, for example up to 100 MHz in some applications. This inevitably produces small high-frequency spikes or glitches in the total current drawn from the reference voltage circuitry. At high frequencies the output impedance $Z_O$, which is essentially inductive, will be high. Accordingly, any high-frequency variation in current will cause an undesirable corresponding variation in the reference voltage which is delivered from the voltage reference generating circuitry (at node A in FIG. 2).

In practice, it is desirable that the output impedance of the reference voltage generating circuitry is stable beyond the actual clock frequency applied to the switching elements themselves, as the fast switching times of the switching elements will cause higher-frequency transients to be generated.

In precision applications, for example in high-speed digital-to-analog converters (DACs) or analog-to-digital converters (ADCs) which are clocked at rates of around 100 MHz or more, the variation in reference voltage caused by high-frequency variation in the load circuitry is highly significant.

Accordingly, it is desirable to provide reference voltage generating circuitry capable of generating a reference voltage which is less susceptible to the effects of such high-frequency load variation.

SUMMARY OF THE INVENTION

According to a first aspect of the present invention there is provided an integrated circuit device comprising: a load node at which a reference voltage is generated when the device is in use; load circuitry connected to said load node for receiving therefrom said reference voltage; a reference voltage amplifier having an output whose impedance has an effective inductive component in a desired range of operating frequencies of said load circuitry; a first resistance element, having a preselected resistance, connected between said output and said load node for supplying said reference voltage to that node; a connection terminal to which external capacitance having a preselected capacitance is connected when the device is in use; a second resistance element, having a preselected resistance, connected between said load node and said connection terminal; thereby to reduce an impedance variation with frequency of the load node over said desired range of operating frequencies of the load circuitry.

According to a second aspect of the present invention there is provided an integrated circuit device comprising: a plurality of load nodes at which a reference voltage is generated when the device is in use, each said load node having load circuitry connected thereto for receiving said reference voltage therefrom; a reference voltage amplifier having an output whose impedance has an effective inductive component in a desired range of operating frequencies of said load circuitry; and a connection terminal to which external capacitance having a preselected capacitance is connected when the device is in use; said device further comprising, for each said load node: a first resistance element, having a preselected resistance, connected between said output and said load node concerned for supplying said reference voltage to that node; and a second resistance element, having a preselected resistance, connected between said load node concerned and said connection terminal; thereby to reduce an impedance variation with frequency of said plurality of load nodes over said desired range of operating frequencies of the load circuitry.

According to a third aspect of the present invention there is provided an integrated circuit device comprising: a first load node at which a first reference voltage is generated when the device is in use; a second load node at which a second reference voltage is generated when the device is in use; load circuitry connected between said first and second load nodes for receiving therefrom said first and second reference voltages; respective first and second reference voltage amplifiers, each having an output whose impedance has an effective inductive component in a desired range of operating frequencies of said load circuitry; respective first and second connection terminals to which external capacitance having a preselected capacitance is connected when the device is in use; a first resistance element connected between said output of the first reference voltage amplifier and said first load node for supplying said first reference voltage to that node; a second resistance element connected between said first load node and said first connection terminal; a third resistance element connected between said output of said second reference voltage amplifier and said second load node for supplying said second reference voltage to that node; and a fourth resistance element connected between the second load node and said second connection terminal; each of said first to fourth resistance elements having a preselected resistance; thereby to reduce an impedance variation with frequency of the load node over said desired range of operating frequencies of the load circuitry.

According to a fourth aspect of the present invention there is provided an integrated circuit device comprising: a plurality of pairs of load nodes, each pair being made up of a first load node at which a first reference voltage is generated when the device is in use and a second load node at which a second reference voltage is generated when the device is in use, each pair of said plurality having load circuitry connected between said first and second load nodes of that pair for receiving therefrom said first and second reference voltages; respective first and second reference voltage amplifiers, each having an output whose impedance has an effective inductive component in a desired range of operating frequencies of said load circuitry; and respective first and second connection terminals to which external capacitance having a preselected capacitance is connected when the device is in use; said device further comprising, for each said pair of load nodes: a first resistance element connected between said output of the first reference voltage amplifier and said first load node of the pair concerned for supplying said first reference voltage to that node; a second resistance element connected between said first load node of the pair concerned and said first connection terminal; a third resistance element connected between said output of said second reference voltage amplifier and said second load node of the pair concerned for supplying said second reference voltage to that node; and a fourth resistance element connected between the second load node of the pair concerned and said second connection terminal; each of said first to fourth resistance elements having a preselected resistance; thereby to reduce an impedance variation with frequency of the load node over said desired range of operating frequencies of the load circuitry.

With an integrated circuit device embodying any one of the above-mentioned first to fourth aspects of the present invention, said preselected resistance of each said resistance element is preferably such that a resonator circuit associated with said output of the or each said amplifier is overdamped, said resonator circuit being formed by said effective inductive component of the output impedance of the amplifier concerned and by the resistance elements connected between that output and the connection terminal associated with that output and by said external capacitance connected to that connection terminal. A quality factor of said resonator circuit is preferably in the range from 0.3 to 0.7.

An integrated circuit device embodying any one of the above-mentioned first to fourth aspects of the present invention preferably further comprises internal capacitance connected for compensating for an inductance associated with said connection terminal. Said internal capacitance is preferably connected directly to said output(s) of the reference voltage amplifier(s). Said internal capacitance is preferably connected to the or each said load node via a further resistance element having a resistance of the same order as the resistance of each of said first and second resistance elements.

With an integrated circuit device embodying any one of the above-mentioned first to fourth aspects of the present invention, the impedance of the or each said load node is preferably less than 20 ohms throughout said range of operating frequencies. Said range of operating frequencies is preferably from DC to a frequency higher than 100 MHz. At least one of said resistance elements is preferably provided by a metal tracking portion within the device.

According to a fifth aspect of the present invention there is provided circuitry comprising an integrated circuit device of any one of the above-described first to fourth aspects of the present invention, and further comprising one or more capacitors connected externally of the device to the or each said connection terminal thereof to serve as said external capacitance.

DETAILED DESCRIPTION OF THE PREFERRED EMBODIMENTS

Figure 1:
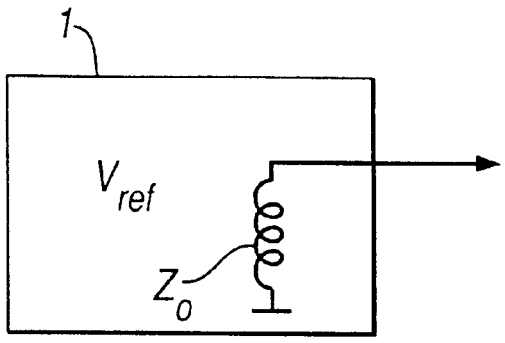
FIG. 1 shows a circuit model of previously-considered reference voltage generating circuitry.
Figure 2:
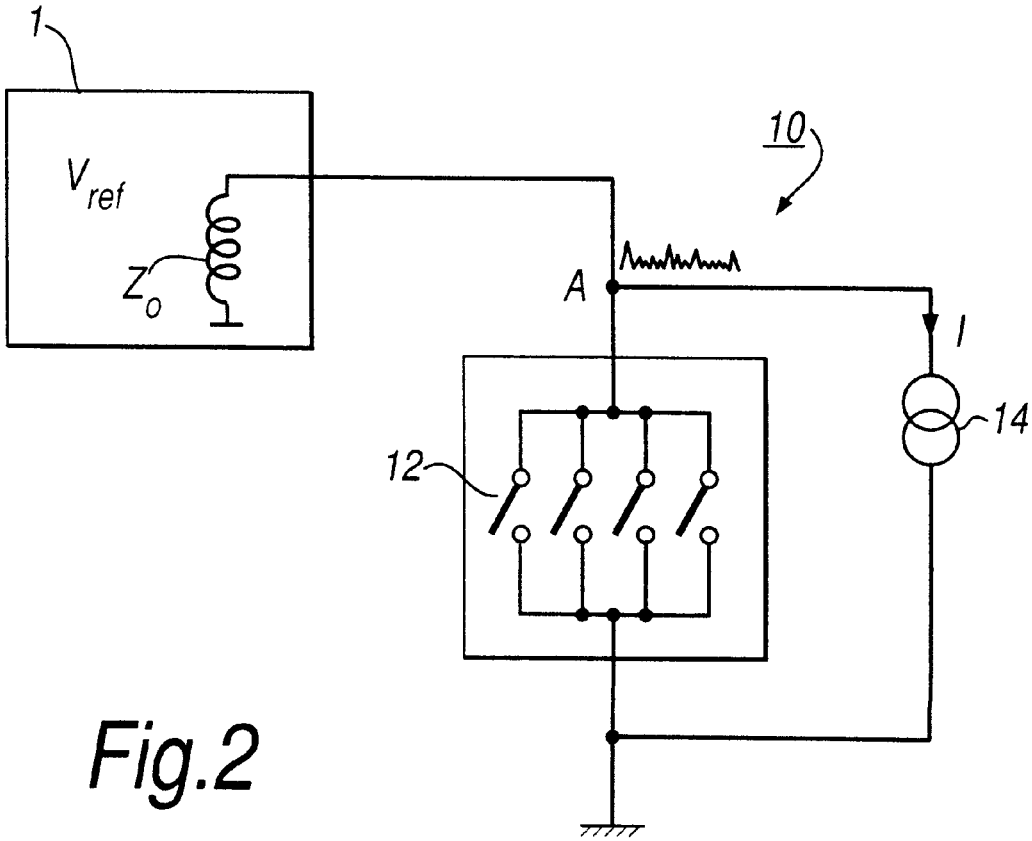
FIG. 2 shows an example in which the FIG. 1 reference voltage generating circuitry is connected to load circuitry.
Figure 3A:
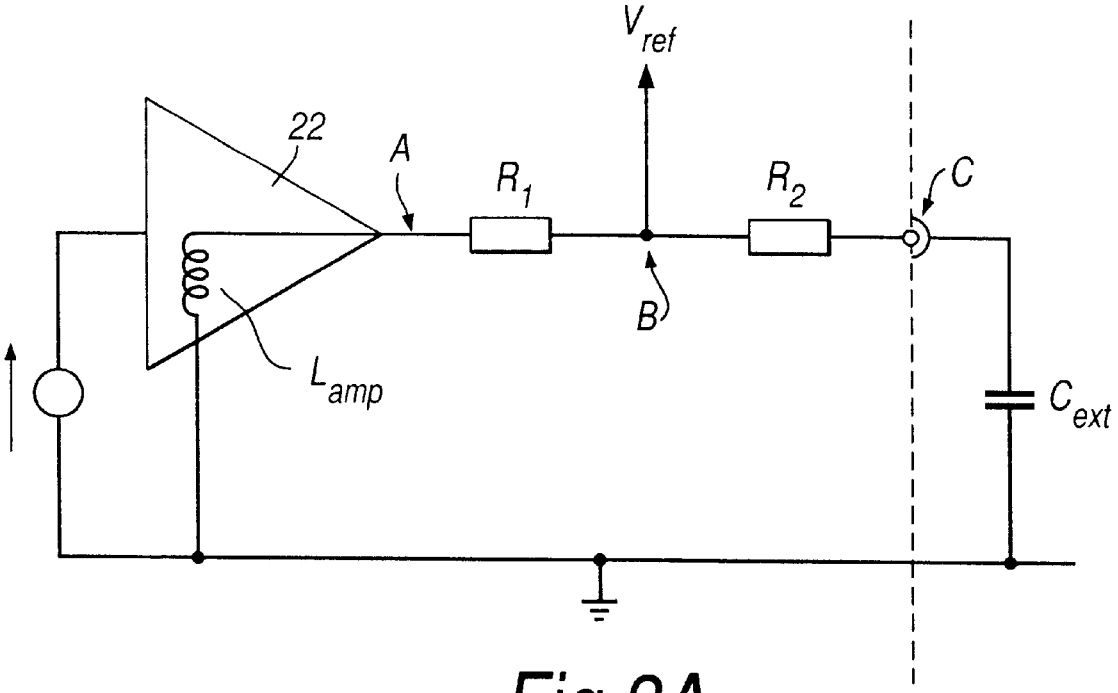
FIG. 3A shows a first embodiment of reference voltage generating circuitry according to the present invention.

FIG. 3A shows reference voltage generating circuitry 20 embodying the present invention. The circuitry 20 is divided into two parts as shown by the dotted line in FIG. 3A. The parts to the left of the dotted line are included in an integrated circuit (IC) which, in general, will also contain further circuitry. For example, the IC may be an ADC IC. The parts to the right of the dotted line are external of the IC (offchip).

As mentioned above, an output impedance of an amplifier in an output stage 22 (buffering stage) of the reference voltage generating circuitry is modelled by a fixed inductance $L_{amp}$. In the FIG. 3A circuitry, a first resistor $R_1$ is connected in series between a node A at the output of the output stage 22 and a node B (load node) at which the reference voltage $V_{ref}$ is output from the circuitry. A second resistor $R_2$ is connected in series between the node B and a node C which is a connection pin of the IC. An external capacitor $C_{ext}$ is connected in series between the node C and a reference line GND.

The reference voltage $V_{ref}$ is fed to load circuitry (not shown) inside the IC which is connected to the node B.

The magnitude Z of the impedance which is seen by the load circuitry connected to node B in FIG. 3 can be shown to be given by:

$$Z=\left\{\left[\frac{R_1R_2(R_1+R_2)+\omega^2L^2R_2+\frac{R_1}{\omega^2C^2}}{(R_1+R_2)^2+\left(\omega L-\frac{1}{\omega C}\right)^2}\right]^2+\left[\frac{\omega LR_2^2-\frac{R_1^2}{\omega C}-\frac{L}{C}\left(\omega L-\frac{1}{\omega C}\right)}{(R_1+R_2)^2+\left(\omega L-\frac{1}{\omega C}\right)^2}\right]^2\right\}^{\frac{1}{2}}$$

Figure 3B:
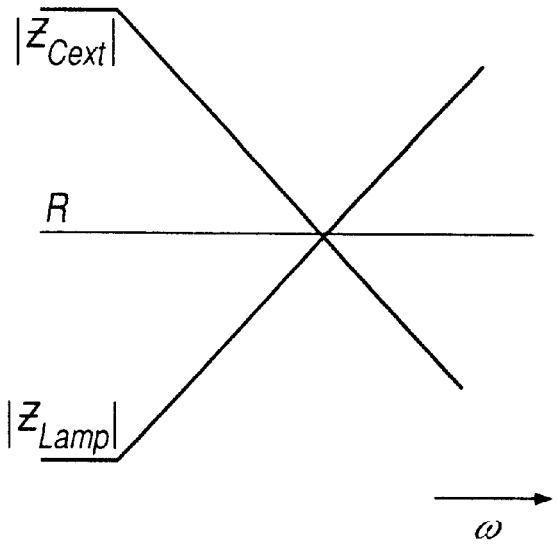
FIG. 3B shows a graph for illustrating impedance variation of components of the FIG. 3A circuitry.

FIG. 3B shows schematically to a logarithmic scale the variation with frequency ω of the magnitude $|Z_C|$ of the impedance $Z_C$ of the capacitor $C_{ext}$ and the magnitude $|Z_L|$ of the impedance $Z_L$ of the inductance $L_{amp}$. As $|Z_C|$ falls with increasing frequency and $|Z_L|$ rises with increasing frequency, at some frequency $\omega_x$ the magnitudes of the two impedances cross over so that both have an impedance of $Z_X$.

It can be shown that, in the circuitry of FIG. 3A, by setting $R_1=R_2=R$ and further setting R to be equal to the cross-over impedance $Z_x$ of L and C, the magnitude of the impedance Z seen at node B of FIG. 3A reduces to:

$$Z=\sqrt{\frac{L}{C}}$$

With the configuration shown in FIG. 3A, therefore, the node B appears to the load circuitry to have a constant impedance which is purely resistive and is independent of frequency ω. In practice, of course, the output impedance of the amplifier in the reference voltage generating circuitry will not be precisely modelled by a fixed inductance $L_{amp}$ and there will be departures from ideal behaviour in other respects too, so the node-B impedance will not be completely resistive and independent of frequency.

The resistors $R_1$ and $R_2$ effectively act as damping resistors in an LC resonator circuit made up of those resistors and the inductance $L_{amp}$ and the capacitor $C_{ext}$. The above-described constant impedance situation occurs when the values of $R_1$ and $R_2$ are set to give critical damping for the LC resonator circuit. In practice it is not usually possible reliably to design the circuitry to be critically damped, for example due to component tolerances and non-ideal behaviour of the operational amplifier. It is therefore preferable to set the values of $R_1$ and $R_2$ to give slight over-damping (e.g. a nominal quality factor Q in the range from 0.3 to 0.7), so that, allowing for component tolerances and other factors, under-damping does not occur.

Based on simulations and/or actual measurements, in one embodiment of the invention $L_{amp}$ is approximately 1 μH. The capacitor $C_{ext}$ can be set to any arbitrary value, although it is preferably within the range from 10 nF to 1 μF. If $C_{ext}$ is below 10 nF the output impedance Z will be too large, and if C is greater than 1 μF the capacitor will be too bulky and expensive. In one embodiment, a capacitor C of 0.1 μF is used. In this case the cross-over impedance, and therefore the value of the resistance R, is 3.16Ω. To design for slight over-damping, a resistance value R of, for example, 3.5Ω can be used.

Figure 4A:
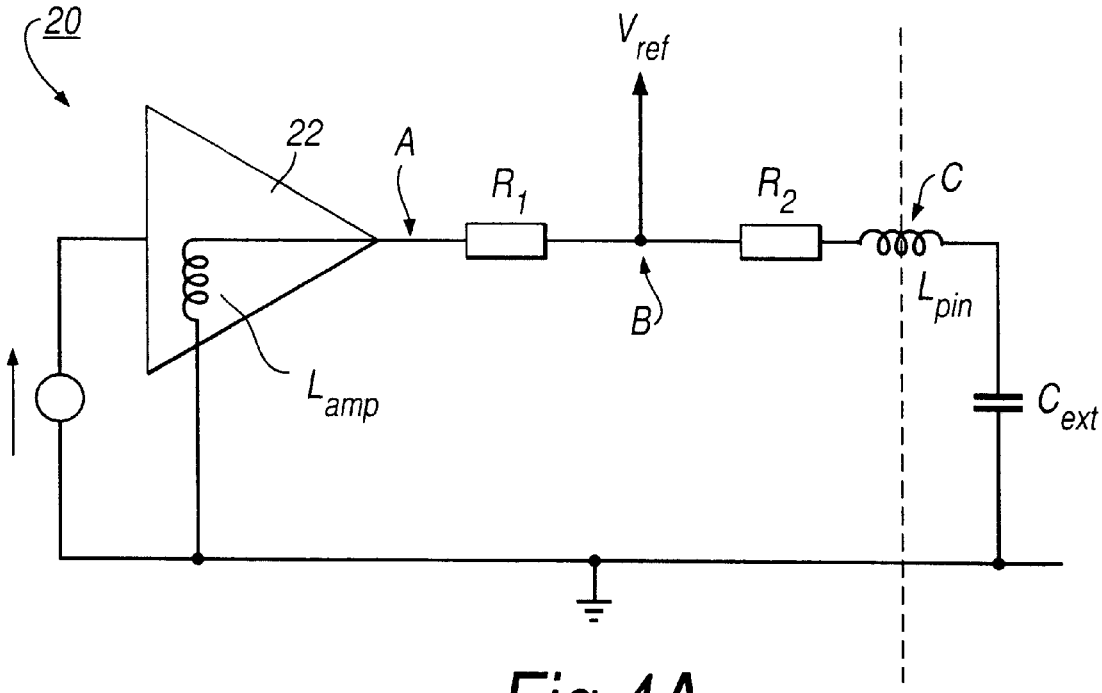
FIG. 4A shows an enhanced circuit model of reference voltage generating circuitry embodying the present invention.

In the FIG. 3A circuitry to obtain a desirably low output impedance Z (e.g. a few ohms), the capacitor needs to be quite large, and so is placed offchip. Because the capacitor is offchip there may be a potentially-significant stray inductance $L_{pin}$ associated with the connection via the connection pin of the IC to the external capacitor. This connection inductance $L_{pin}$ can be included in an enhanced circuit model of the circuitry 20, as shown in FIG. 4A. The connection inductance $L_{pin}$ also includes any inductance associated with the external capacitor $C_{ext}$ itself, as well as with external wiring such as printed-circuit-board tracks connecting the capacitor to the IC connection pin.

Figure 4B:
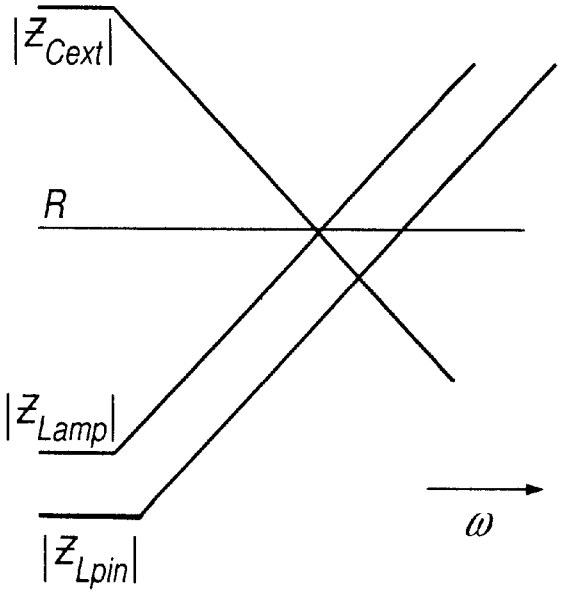
FIG. 4B shows a graph for illustrating impedance variation of components of the FIG. 4A model.

The variation with frequency of the magnitude of the impedance of each of the components in FIG. 4A is shown schematically in FIG. 4B. The inclusion of the connection inductance has the effect of increasing the overall output impedance of the reference voltage generating circuitry at high frequencies, e.g. frequencies higher than 10 MHz. The connection inductance $L_{pin}$ for example, in the region of 5 nH.

Figure 5A:
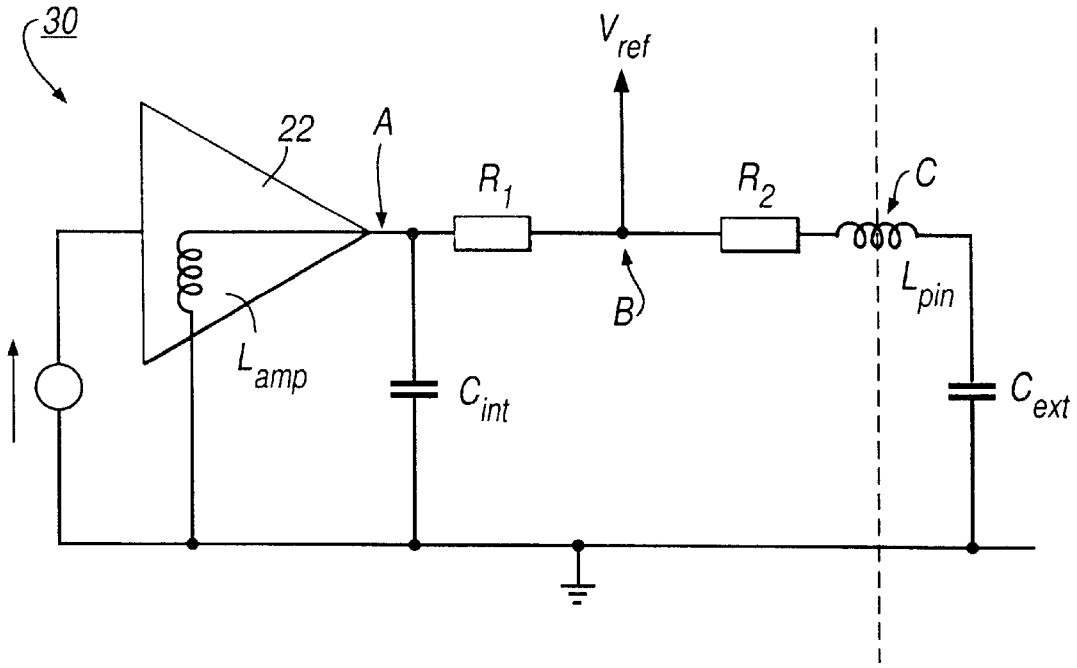
FIG. 5A shows a second embodiment of reference voltage generating circuitry according to the present invention.
Figure 5B:
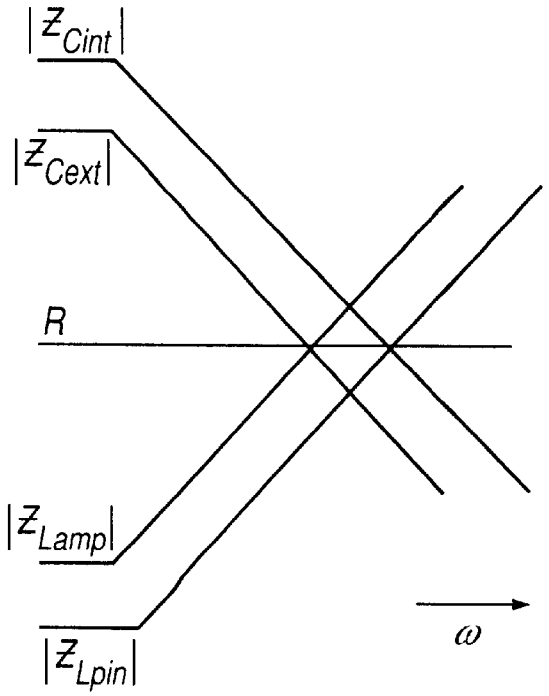
FIG. 5B shows a graph for illustrating impedance variation of components of the FIG. 5A circuitry.

In a second embodiment of the present invention, shown in FIG. 5A, the effect of increasing impedance at high frequencies caused by the connection inductance is compensated for by adding an internal (on-chip) capacitor $C_{int}$ at the output of the amplifier. The variation with frequency of the magnitude of the impedance of each of the components of FIG. 5A is shown schematically in FIG. 5B. The value of the on-chip capacitor $C_{int}$ should preferably be chosen so that it has an impedance equal to the constant resistance at the frequency at which the impedance of the connection inductance $L_{pin}$ crosses the constant resistance line R. Using the same component values as described above (with $L_{amp}$=1 μH, $C_{ext}$=0.1 μF, R=3.16Ω and $L_{pin}$=5 nH) it can be shown that the on-chip capacitor $C_{int}$ should have a value of 0.5 nF. With these component values, the impedance seen at node B in the FIG. 5A circuitry is a constant 3.16Ω across all frequencies.

For circuits where a constant impedance at high frequencies is not required, the on-chip capacitor $C_{int}$ can be omitted.

Figure 6:
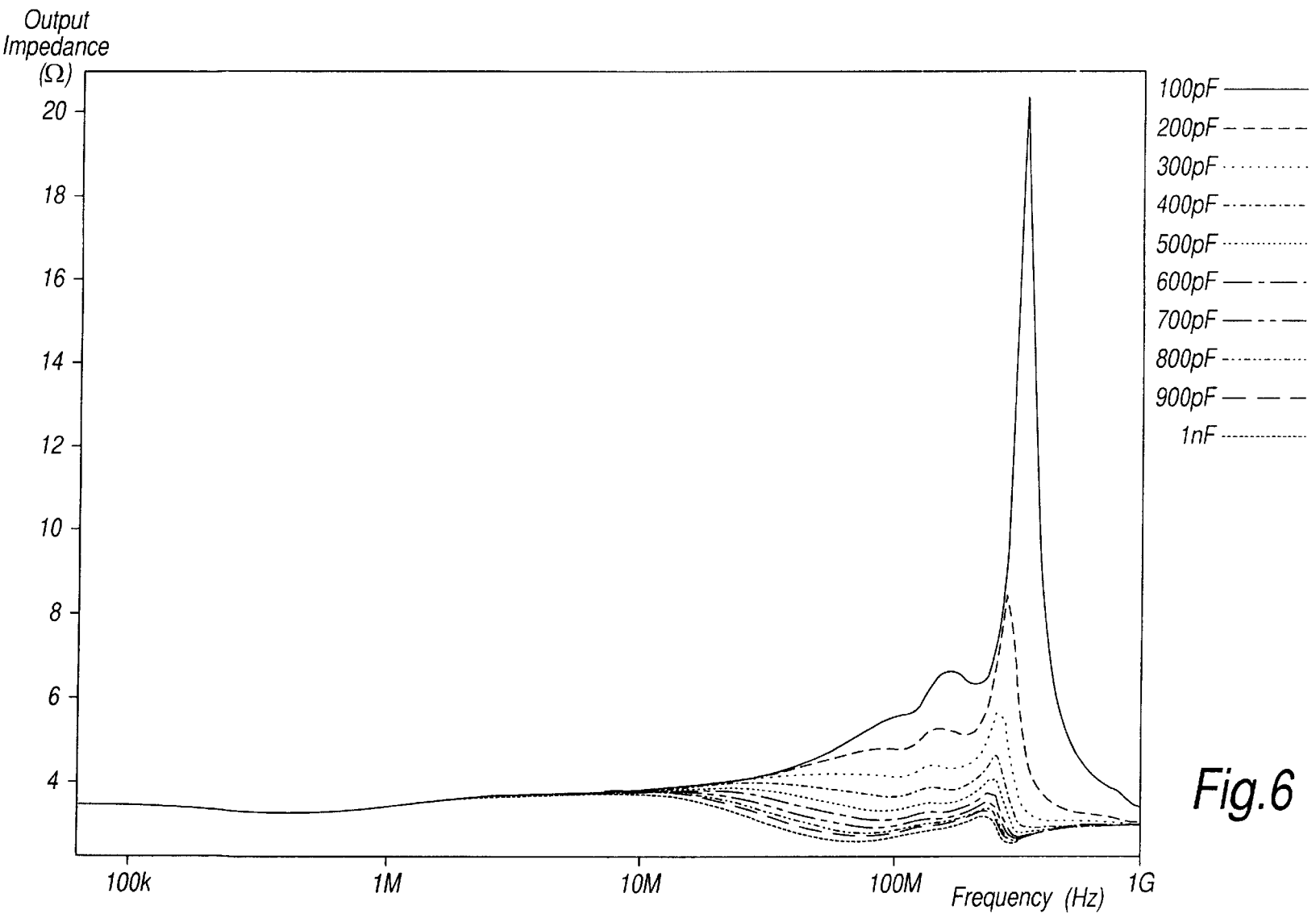
FIG. 6 shows the variation with frequency of an output impedance of reference voltage generating circuitry embodying the present invention for various capacitance values of an internal capacitor included in the circuitry.

FIG. 6 shows the variation of the output impedance, as measured at node B in the FIG. 5A circuitry, with frequency for several different values of on-chip capacitance $C_{int}$. In this example it can be seen that the above-mentioned value of 0.5 nF gives the most constant output impedance among the values tested. It can be also seen that other values from 200 pF to 1 nF or more give useful results in terms of providing a relatively constant output impedance at frequencies higher than 10 MHz.

Incidentally, the respective resistive components of the amplifier output impedance, the connection impedance ($L_{pin}$ etc.) and the internal-capacitor impedance and the external-capacitor impedance are typically very small. For example, usually these resistive components may be of the order of 0.1Ω. For this reason the resistive components have been ignored in the above-mentioned embodiments.

If any of these resistive components is not negligible for some reason, then the or each significant resistive component should be taken into account when setting the resistance values of the "additional" resistors $R_1$ and $R_2$. In particular, the sum of the additional resistance $R_1$ and any significant resistive components of the amplifier output impedance and of the internal-capacitor impedance should then be set equal to the sum of the additional resistance $R_2$ and any significant resistive components of the connection impedance and external-capacitor impedance.

The above-described embodiments of the present invention have employed the reference voltage generating circuitry in a "single-ended" configuration. The present invention is also applicable to a differential or "bridged" configuration, such as in the third embodiment shown in FIG. 7.

Figure 7:
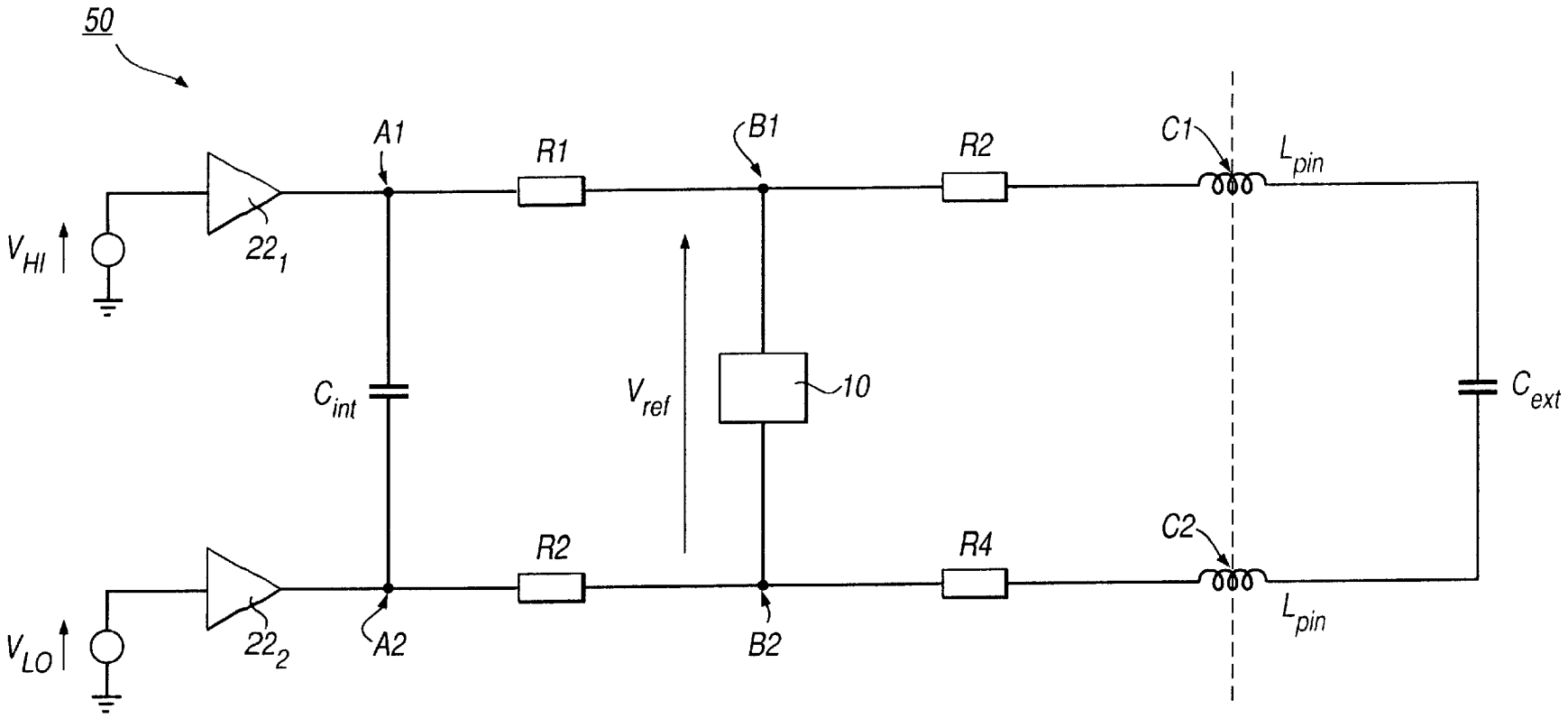
FIG. 7 shows a third embodiment of reference voltage generating circuitry according to the present invention.

In the FIG. 7 embodiment, reference voltage generating circuitry 50 in an IC includes two operational amplifiers $\mathbf{22}_1$ and $\mathbf{22}_2$ in place of the single operational amplifier 22 in the single-ended configuration. Each amplifier 22 receives at its input a reference potential $V_{HI}$ or $V_{LO}$ and buffers the reference potential at its output (nodes A1 and A2). As for the single-ended embodiments, an output impedance of each of the amplifiers 22 may be adequately modelled by a fixed inductance $L_{amp}$.

In the FIG. 7 circuitry, load circuitry 10, to which a reference voltage $V_{ref}$ ($=V_{HI}-V_{LO}$) generated by the circuitry 50 is to be applied, is connected between nodes B1 and B2 (load nodes). The node B1 is connected to the node A1 by a resistor R1. Similarly, the node B2 is connected to the node A2 by a resistor R3.

The IC device including the circuitry 50 also has respective first and second connection pins (nodes C1 and C2) associated respectively with the nodes B1 and B2. The node C1 associated with the node B1 is connected to the node B1 via a resistor R2. Similarly, the node C2 associated with the node B2 is connected to the node B2 via a resistor R4. Each of the connection pins has associated with it a connection-pin inductance $L_{pin}$, as described previously.

In the FIG. 7 circuitry, each of the resistors R1 to R4 should have the same resistance value R as each of the resistors R1 and R2 in the single-ended embodiments described above.

It would be possible in the FIG. 7 circuitry to connect a separate external capacitor to each of the connection pins (nodes C1 and C2), each external capacitor serving to compensate for an output inductance $L_{amp}$ of its associated one of the amplifier element 51. In this case, each external capacitor would be connected between the connection pin and ground, and would have its capacitance value selected in the same way as in the single-ended embodiments described above.

However, it will be appreciated that, because the two external capacitors would effectively be connected in series (via ground) between the two connection pins (nodes C1 and C2), those two external capacitors can be replaced by a single external capacitor $C_{ext}$ as shown in FIG. 7. This reduces cost, and also makes the arrangements for the external capacitor more compact and simple on a circuit board on which the IC is mounted. Furthermore, the single external capacitor $C_{ext}$ used in the bridged configuration of FIG. 7 can provide as low an output impedance as the single-ended embodiments with only half the capacitance value of the external capacitor used in the single-ended embodiments (assuming that the inductance $L_{amp}$ of each of the amplifiers 51 in the FIG. 7 circuitry is the same as the output inductance of the amplifier 22 used in the single-ended embodiments). This leads to further cost reductions and space savings.

Similarly, in the FIG. 7 circuitry a single internal capacitor $C_{int}$ is connected directly between the amplifier output nodes A1 and A2 to compensate for the connection inductances associated with the connection pins (nodes C1 and C2) and with the external capacitor(s). Again, two separate internal capacitors could be used for this purpose, each being connected between one of the amplifier output nodes A1 and A2 and ground, but the same effect can be achieved using a single internal capacitor $C_{int}$ having half the capacitance value of the internal capacitor used in the single-ended embodiments described above. This again can lead to a more compact arrangement within the IC itself.

Incidentally, in the FIG. 7 circuitry it is also possible to employ both a "bridging" external capacitor connected between the two connection pins (nodes C1 and C2) and two further external capacitors, each connected between one of the connection pins and ground. In this, any suitable combination of capacitance values giving each connection pin an effective associated capacitance equal to the capacitance employed in the single-ended embodiments can be used. For example, all three external capacitors could have a capacitance of one quarter the capacitance employed in the single-ended embodiments.

Figure 8:
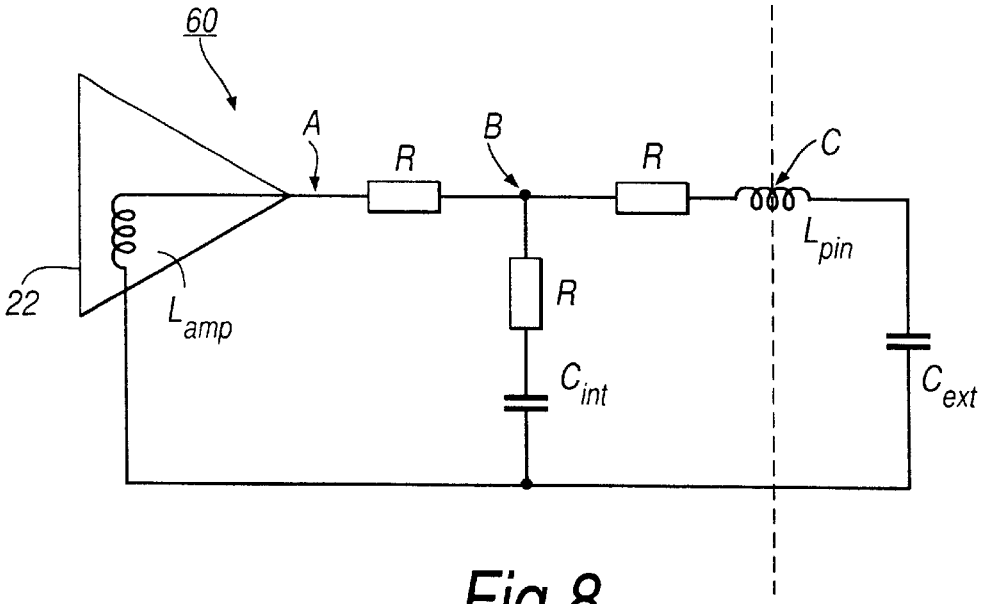
FIG. 8 shows a modification applicable to the second embodiment of FIG. 5A.

In the second embodiment (FIG. 5A), the internal capacitor $C_{int}$ used to compensate for the connection inductance $L_{pin}$ was connected between the node A and ground. However, as shown in FIG. 8, it is also possible to achieve the same effect by connecting the internal capacitor $C_{int}$ between ground and the node B (load node), although in this case a further resistor having the same resistance value R as the other resistors in the circuitry is connected in series with the internal capacitor $C_{int}$. It is also possible to apply the same modification to the bridged configuration shown in FIG. 7. In this case, instead of connecting the internal capacitance $C_{int}$ between the nodes A1 and A2, the internal capacitor $C_{int}$ is connected between the nodes B1 and B2, with a series resistor having a resistance of 2R in series with it.

Figure 9:
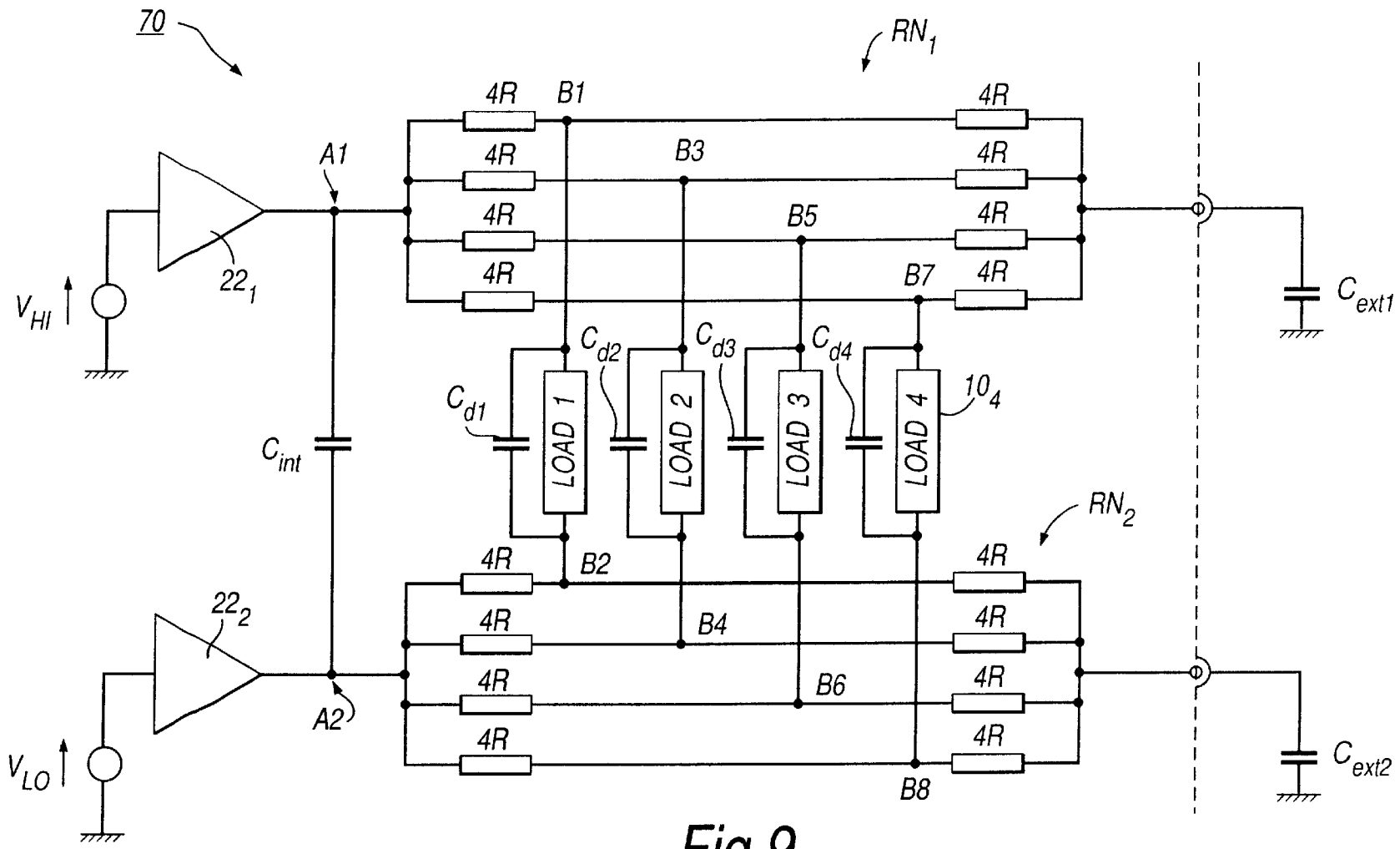
FIG. 9 shows a fourth embodiment of reference voltage generating circuitry according to the present invention.

FIG. 9 shows a fourth embodiment of the present invention in which reference voltage generating circuitry 70 embodying the present invention is also applied in a bridged configuration. In this embodiment, instead of a single set of load circuitry, four sets of load circuitry $\mathbf{10}_1$ to $\mathbf{10}_4$ are provided within the same IC device. For example, each set of load circuitry $\mathbf{10}_1$ to $\mathbf{10}_4$ may comprise an analog-to-digital converter (ADC).

In the FIG. 9 circuitry, different reference potentials $V_{HI}$ and $V_{LO}$ are applied respectively to the input of a pair of amplifiers $\mathbf{22}_1$ and $\mathbf{22}_2$, and the resulting buffered potentials are output by the amplifiers 22 at nodes A1 and A2 respectively. Each amplifier output node A1 or A2 is connected via a resistor network $RN_1$ or $RN_2$ made up of eight individual resistors to an associated connection pin of the IC (node C1 or C2). Each of the eight resistors in the resistor network has a resistance value of 4R, where R is the resistance value of each of the resistors R1 and R2 in the single-ended embodiments described above.

Each resistor network $RN_1$ or $RN_2$ has four parallel branches, each branch having two of the individual 4R resistors connected in series. The nodes B1 to B8 are the common nodes at which the two resistors in each branch are connected together. Each set of load circuitry $\mathbf{10}_1$ to $\mathbf{10}_4$ is connected between one of the common nodes B1, B3, B5 and B7 of the first resistor network $RN_1$ and a corresponding one of the common nodes B2, B4, B6 and B8 of the second resistor network $RN_2$. Also connected across each set of load circuitry $10_1$ to $10_4$ is a decoupling capacitor $C_{d1}$ to $C_{d4}$.

It can be seen that, as the four branches of each resistor network $RN_1/RN_2$ are connected in parallel with one another between the node A1/A2 and the node C1/C2, a combined resistance of the eight resistors in the network is 2R, as in the previous embodiments.

In this embodiment, each connection pin (node C1 or C2) has its own external capacitor $C_{ext1}$ or $C_{ext2}$ connected between the pin and ground. Each external capacitor $C_{ext1}$ and $C_{ext2}$ serves, as described previously, to compensate for an effective inductive component of the output impedance of an associated one of the amplifiers 22, and the capacitance value is selected as described previously in relation to the single-ended embodiments. Alternatively, in place of the two external capacitors $C_{ext1}$ and $C_{ext2}$, a single external capacitor having half the value of each of the external capacitors $C_{ext1}$ and $C_{ext2}$ may be used, as in the FIG. 7 embodiment.

In use of the circuitry 70, each set of load circuitry $10_1$ to $10_4$ receives the same reference voltage $V_{ref}$ determined by the difference between the reference potentials $V_{HI}$ and $V_{LO}$ applied to the two amplifiers 22. An impedance of the circuitry 70, as seen by each set of load circuitry $10_1$ to $10_4$, is substantially constant over a wide range of frequencies, as in the previous embodiments.

Because each set of load circuitry $10_1$ to $10_4$ has its own associated branch within each of the resistor networks $RN_1$ and $RN_2$ the amount of coupling between the different sets of load circuitry is reduced substantially as compared to a situation in which all of the sets were supplied from the same pair of nodes (e.g. the nodes B1 and B2 in FIG. 7).

Figure 10:
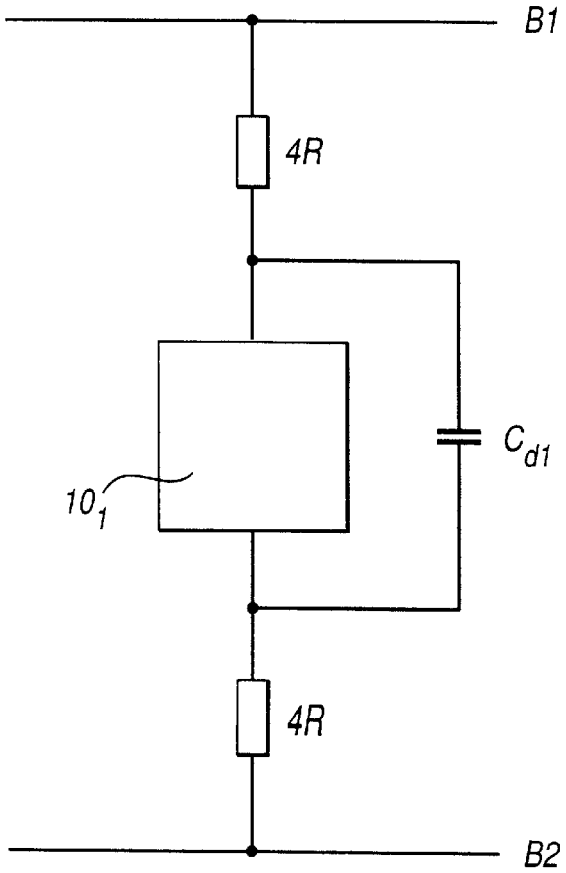
FIG. 10 shows a circuit model of parts of the FIG. 9 circuitry.

FIG. 10 shows an equivalent circuit of the first set of load circuitry $10_1$ in the FIG. 9 circuitry. When, for example, R is approximately 3Ω (as in the single-ended embodiments described above), 4R is approximately 12Ω. If the load circuitry $10_1$ is clocked at a rate of, for example, 100 MHz, a suitable value for the decoupling capacitor $C_{d1}$ is of the order of 80 pF, giving an effective RC time constant $\tau$ for the decoupling arrangement of approximately 1 ns. In this way, the different sets of load circuitry can be decoupled from one another highly effectively.

The FIG. 9 embodiment can also be adapted for use in a single-ended configuration in which, for example, the different sets of load circuitry each receive the same reference voltage that is referenced to ground. In this case, the second resistor network $RN_2$ is not required, but the first resistor network $RN_1$ is retained to supply the reference voltage "separately" to each set of load circuitry.

In the above-described FIG. 9 embodiment, each resistor in each resistor network $RN_1/RN_2$ had a resistance value of 4R, in order that the combined resistance of the eight resistors in each network was 2R. It will be appreciated that it is not necessary that the value of each resistor in one branch of a resistor network is the same as that of each resistor in another branch of that resistor network, simply that the combined resistance of the resistor network is 2R. For instance, if a first set of the load circuitry 10 draws a larger current than a second set of load circuitry 10, then the resistance value chosen for the branch associated with the first set of load circuitry 10 may be set lower than the resistance value chosen for the branch associated with the second set of load circuitry 10, whilst keeping the combined resistance of the resistor network as 2R. If, for example, binary-weighted current is drawn from adjacent loads 10, then binary-weighted branch resistance values may be used, in inverse proportion to the current loading on that branch. Such binary-weighted values would be (15/8)R, (15/4)R, (15/2)R and 15R.

Since it can be difficult to fabricate resistors which have a small resistance value reliably (for example using polysilicon), resistors for use in embodiments of the present invention may be formed from internal metal tracking. For example, resistor R1 in FIG. 5A may be formed from metal tracking leading from the output of amplifier 22 (node A) to node B. Such metal tracking typically has a resistance of 0.1 Ω/square. If a resistance of 2Ω is required then 20 squares are needed, and if the physical distance between nodes A and B in FIG. 5A is 500 μm, then the width of the tracking should be 25 μm.

It will be appreciated that, although in the embodiments described above, the amplifiers have simply buffered the reference potentials applied to them, an amplifier which produces an output voltage of a different level from the input voltage it receives could also be used. For example, the or each amplifier could perform a voltage doubling function or other level adjustment function.

It will also be appreciated that embodiments of the present invention are applicable in any situation in which it is desired to generate, in an integrated circuit, a reference voltage for use by circuitry within integrated circuit. The load circuitry to which the reference voltage is applied need not be analog-to-digital conversion circuitry or digital-to-analog conversion circuitry, as described previously, but can be any suitable kind of circuitry.

Similarly, it is not necessary for the reference voltage generated by the reference voltage generating circuitry embodying the present invention to be completely constant over time. For example, it would be possible to apply the invention in applications in which it is necessary for the reference voltage to change slowly over time.

What is claimed is:

1. An integrated circuit device comprising:

a load node at which a reference voltage is generated when the device is in use;

load circuitry connected to said load node for receiving therefrom said reference voltage;

a reference voltage amplifier having an output whose impedance has an effective inductive component in a desired range of operating frequencies of said load circuitry;

a first resistance element, having a preselected resistance, connected between said output and said load node for supplying said reference voltage to that node;

a connection terminal to which external capacitance having a preselected capacitance is connected when the device is in use;

a second resistance element, having a preselected resistance, connected between said load node and said connection terminal;

thereby to reduce an impedance variation with frequency of the load node over said desired range of operating frequencies of the load circuitry.

2. A device as claimed in claim 1, wherein the preselected resistance of each said resistance element is of the same order as a magnitude of said effective inductive component of the amplifier output impedance at a frequency at which that inductive-component impedance has the same magnitude as an impedance of said external capacitance.

3. A device as claimed in claim 1, further comprising internal capacitance connected for compensating for an inductance associated with said connection terminal.

4. A device as claimed in claim 3, wherein said internal capacitance has an impedance of approximately the same magnitude as said preselected resistance of each said resistance element at a frequency at which the impedance of said internal capacitance has the same magnitude as the connection-terminal inductance.

5. A device as claimed in claim 1, wherein said load circuitry is also connected to a reference line of the device which, in use of the device, is maintained at a predetermined potential, and said external capacitance comprises an external capacitor connected between said connection terminal and said reference line.

6. A device as claimed in claim 5, further comprising internal capacitance connected for compensating for an inductance associated with said connection terminal, wherein said internal capacitance comprises an internal capacitor connected between said output and said reference line.

7. A device as claimed in claim 1, wherein said preselected resistance of each said resistance element is such that a resonator circuit associated with said output of the or each said amplifier is overdamped, said resonator circuit being formed by said effective inductive component of the output impedance of the amplifier concerned and by the resistance elements connected between that output and the connection terminal associated with that output and by said external capacitance connected to that connection terminal.

8. An integrated circuit device comprising:

a plurality of load nodes at which a reference voltage is generated when the device is in use, each said load node having load circuitry connected thereto for receiving said reference voltage therefrom;

a reference voltage amplifier having an output whose impedance has an effective inductive component in a desired range of operating frequencies of said load circuitry; and a connection terminal to which external capacitance having a preselected capacitance is connected when the device is in use;

said device further comprising, for each said load node:

a first resistance element, having a preselected resistance, connected between said output and said load node concerned for supplying said reference voltage to that node; and a second resistance element, having a preselected resistance, connected between said load node concerned and said connection terminal;

thereby to reduce an impedance variation with frequency of said plurality of load nodes over said desired range of operating frequencies of the load circuitry.

9. A device as claimed in claim 8, wherein the preselected resistance of each said resistance element is such that one half of a combined resistance, provided by all of said elements, between said output and said connection terminal is of the same order as a magnitude of said effective inductive component of the amplifier output impedance at a frequency at which that inductive-component impedance has the same magnitude as an impedance of said external capacitance.

10. A device as claimed in claim 8, further comprising internal capacitance connected for compensating for an inductance associated with said connection terminal.

11. A device is claimed in claim 10, wherein said internal capacitance has an impedance of approximately the same magnitude as one half of a combined resistance, provided by all of said elements, between said output and said connection terminal at a frequency at which the impedance of said internal capacitance has the same magnitude as the connection-terminal inductance.

12. A device as claimed in claim 8, wherein said load circuitry is also connected to a reference line of the device which, in use of the device, is maintained at a predetermined potential, and said external capacitance comprises an external capacitor connected between said connection terminal and said reference line.

13. A device as claimed in claim 12, further comprising internal capacitance connected for compensating for an inductance associated with said connection terminal, wherein said internal capacitance comprises an internal capacitor connected between said output and said reference line.

14. A device as claimed in claim 8, wherein said preselected resistance of each said resistance element is such that a resonator circuit associated with said output of the or each said amplifier is overdamped, said resonator circuit being formed by said effective inductive component of the output impedance of the amplifier concerned and by the resistance elements connected between that output and the connection terminal associated with that output and by said external capacitance connected to that connection terminal.

15. An integrated circuit device comprising:

a first load node at which a first reference voltage is generated when the device is in use;

a second load node at which a second reference voltage is generated when the device is in use;

load circuitry connected between said first and second load nodes for receiving therefrom said first and second reference voltages;

respective first and second reference voltage amplifiers, each having an output whose impedance has an effective inductive component in a desired range of operating frequencies of said load circuitry;

respective first and second connection terminals to which external capacitance having a preselected capacitance is connected when the device is in use;

a first resistance element connected between said output of the first reference voltage amplifier and said first load node for supplying said first reference voltage to that node;

a second resistance element connected between said first load node and said first connection terminal;

a third resistance element connected between said output of said second reference voltage amplifier and said second load node for supplying said second reference voltage to that node; and a fourth resistance element connected between the second load node and said second connection terminal;

each of said first to fourth resistance elements having a preselected resistance;

thereby to reduce an impedance variation with frequency of the load node over said desired range of operating frequencies of the load circuitry.

16. A device as claimed in claim 15, wherein the preselected resistance of each said resistance element is of the same order as a magnitude of said effective inductive component of the output impedance of each said amplifier at a frequency at which that inductive-component impedance has the same magnitude as an impedance of an external capacitance, associated with each individual said connection terminal, provided by the external capacitance.

17. A device as claimed in claim 15, further comprising internal capacitance connected for compensating for an inductance associated with each said connection terminal.

18. A device as claimed in claim 17, wherein said internal capacitance comprises a single internal capacitor connected between the respective outputs of the first and second amplifier.

19. A device is claimed in claim 17, wherein said internal capacitance provides each said amplifier with an associated internal capacitance, and each said associated internal capacitance has an impedance of approximately the same magnitude as said preselected resistance of each said resistance element at a frequency at which the associated-internal-capacitance impedance has the same magnitude as the inductance of each said connection terminal.

20. A device as claimed in claim 15, wherein said preselected resistance of each said resistance element is such that a resonator circuit associated with said output of the or each said amplifier is overdamped, said resonator circuit being formed by said effective inductive component of the output impedance of the amplifier concerned and by the resistance elements connected between that output and the connection terminal associated with that output and by said external capacitance connected to that connection terminal.

21. An integrated circuit device comprising:

a plurality of pairs of load nodes, each pair being made up of a first load node at which a first reference voltage is generated when the device is in use and a second load node at which a second reference voltage is generated when the device is in use, each pair of said plurality having load circuitry connected between said first and second load nodes of that pair for receiving therefrom said first and second reference voltages;

respective first and second reference voltage amplifiers, each having an output whose impedance has an effective inductive component in a desired range of operating frequencies of said load circuitry; and respective first and second connection terminals to which external capacitance having a preselected capacitance is connected when the device is in use;

said device further comprising, for each said pair of load nodes:

a first resistance element connected between said output of the first reference voltage amplifier and said first load node of the pair concerned for supplying said first reference voltage to that node;

a second resistance element connected between said first load node of the pair concerned and said first connection terminal;

a third resistance element connected between said output of said second reference voltage amplifier and said second load node of the pair concerned for supplying said second reference voltage to that node; and a fourth resistance element connected between the second load node of the pair concerned and said second connection terminal;

each of said first to fourth resistance elements having a preselected resistance;

thereby to reduce an impedance variation with frequency of the load node over said desired range of operating frequencies of the load circuitry.

22. A device as claimed in claim 21, wherein the preselected resistance of each said resistance element is such that one half of a combined resistance, provided by all of said elements, between said output of each said amplifier and its associated one of said connection terminals is of the same order as a magnitude of said effective inductive component of the output impedance of each said amplifier at a frequency at which that inductive-component impedance has the same magnitude as an impedance of an external capacitance, associated with each individual said connection terminal, provided by the external capacitance.

23. A device as claimed in claim 21, further comprising internal capacitance connected for compensating for an inductance associated with each said connection terminal.

24. A device is claimed in claim 23, wherein said internal capacitance provides each said amplifier with an associated internal capacitance, and each said associated internal capacitance has an impedance of approximately the same magnitude as one half of a combined resistance, provided by all of said elements, between said output and said connection terminal at a frequency at which the associated-internal-capacitance impedance has the same magnitude as the inductance of each said connection terminal.

25. A device as claimed in claim 23, wherein said internal capacitance comprises a single internal capacitor connected between the respective outputs of the first and second amplifier.

26. A device as claimed in claim 15, wherein said external capacitance comprises a single external capacitor connected between said first and second connection terminals.

27. A device as claimed in claim 21, wherein said preselected resistance of each said resistance element is such that a resonator circuit associated with said output of the or each said amplifier is overdamped, said resonator circuit being formed by said effective inductive component of the output impedance of the amplifier concerned and by the resistance elements connected between that output and the connection terminal associated with that output and by said external capacitance connected to that connection terminal.

28. An integrated circuit device comprising:

a load node at which a reference voltage is generated when the device is in use;

load circuitry connected to said load node for receiving therefrom said reference voltage;

reference voltage amplifier means having an output whose impedance has an effective inductive component in a desired range of operating frequencies of said load circuitry;

a first resistance element, having a preselected resistance, connected between said output and said load node for supplying said reference voltage to that node;

a connection terminal to which external capacitor means having a preselected capacitance are connected when the device is in use;

a second resistance element, having a preselected resistance, connected between said load node and said connection terminal;

thereby to reduce an impedance variation with frequency of the load node over said desired range of operating frequencies of the load circuitry.

29. An integrated circuit device comprising:

a plurality of load nodes at which a reference voltage is generated when the device is in use, each said load node having load circuitry connected thereto for receiving said reference voltage therefrom;

reference voltage amplifier means having an output whose impedance has an effective inductive component in a desired range of operating frequencies of said load circuitry; and a connection terminal to which external capacitor means having a preselected capacitance are connected when the device is in use;

said device further comprising, for each said load node:

a first resistance element, having a preselected resistance, connected between said output and said load node concerned for supplying said reference voltage to that node; and a second resistance element, having a preselected resistance, connected between said load node concerned and said connection terminal;

thereby to reduce an impedance variation with frequency of said plurality of load nodes over said desired range of operating frequencies of the load circuitry.

30. An integrated circuit device comprising:

a first load node at which a first reference voltage is generated when the device is in use;

a second load node at which a second reference voltage is generated when the device is in use;

load circuitry connected between said first and second load nodes for receiving therefrom said first and second reference voltages;

respective first and second reference voltage amplifier means, each having an output whose impedance has an effective inductive component in a desired range of operating frequencies of said load circuitry;

respective first and second connection terminals to which external capacitor means having a preselected capacitance are connected when the device is in use;

a first resistance element connected between said output of the first reference voltage amplifier means and said first load node for supplying said first reference voltage to that node;

a second resistance element connected between said first load node and said first connection terminal;

a third resistance element connected between said output of said second reference voltage amplifier means and said second load node for supplying said second reference voltage to that node; and a fourth resistance element connected between the second load node and said second connection terminal;

each of said first to fourth resistance elements having a preselected resistance;

thereby to reduce an impedance variation with frequency of the load node over said desired range of operating frequencies of the load circuitry.

31. An integrated circuit device comprising:

a plurality of pairs of load nodes, each pair being made up of a first load node at which a first reference voltage is generated when the device is in use and a second load node at which a second reference voltage is generated when the device is in use, each pair of said plurality having load circuitry connected between said first and second load nodes of that pair for receiving therefrom said first and second reference voltages;

respective first and second reference voltage amplifier means, each having an output whose impedance has an effective inductive component in a desired range of operating frequencies of said load circuitry; and respective first and second connection terminals to which external capacitor means having a preselected capacitance are connected when the device is in use;

said device further comprising, for each said pair of load nodes:

a first resistance element connected between said output of the first reference voltage amplifier means and said first load node of the pair concerned for supplying said first reference voltage to that node;

a second resistance element connected between said first load node of the pair concerned and said first connection terminal;

a third resistance element connected between said output of said second reference voltage amplifier means and said second load node of the pair concerned for supplying said second reference voltage to that node; and a fourth resistance element connected between the second load node of the pair concerned and said second connection terminal;

each of said first to fourth resistance elements having a preselected resistance;

thereby to reduce an impedance variation with frequency of the load node over said desired range of operating frequencies of the load circuitry.

* * * * *

UNITED STATES PATENT AND TRADEMARK OFFICE

CERTIFICATE OF CORRECTION

PATENT NO. : 6,329,870 B1
DATED : December 11, 2001
INVENTOR(S) : Ian Juso Dedic It is certified that error appears in the above-identified patent and that said Letters Patent is hereby corrected as shown below:

Title page,
Item [30], Foreign Application Priority Data, change "9926647" to -- 9926647.0 --.

Signed and Sealed this

Thirtieth Day of July, 2002

*Attest:*

*Attesting Officer*

JAMES E. ROGAN
*Director of the United States Patent and Trademark Office*